US005593193A

United States Patent [19]

Heim

[11] Patent Number: 5,593,193

[45] Date of Patent: Jan. 14, 1997

[54] THUMB ACTUATED LATCH RETRACTING MECHANISM FOR GRIP HANDLE LOCKS INCLUDING INTEGRAL INSTALLATION GRIPPING AID

[75] Inventor: Jonathan R. Heim, Pacifica, Calif.

[73] Assignee: Schlage Lock Company, San Francisco, Calif.

[21] Appl. No.: 648,455

[22] Filed: May 15, 1996

Related U.S. Application Data

[63] Continuation of Ser. No. 296,886, Aug. 29, 1994, abandoned.

[51] Int. Cl.[6] ..... E05B 3/00

[52] U.S. Cl. ..... 292/336.3; 292/165; 292/357; 292/DIG. 53

[58] Field of Search ..... 292/357, 165, 292/170, 169.19, DIG. 53, DIG. 63, 336.3

[56] References Cited

U.S. PATENT DOCUMENTS

| | | | |
|---|---|---|---|
| 2,401,559 | 6/1946 | Falk | 292/165 |
| 3,287,054 | 11/1966 | Russell et al. | 292/336.3 |
| 3,477,754 | 11/1969 | Check | 292/165 |
| 3,985,008 | 10/1976 | Hart | 292/357 X |
| 4,576,405 | 3/1986 | Wartian | 292/191 |
| 4,629,228 | 12/1986 | Marko et al. | 292/165 |
| 4,632,439 | 12/1986 | Miller | 292/166 |
| 4,779,909 | 10/1988 | Hennessy | 292/166 |
| 4,982,986 | 1/1991 | Gresset, Jr. et al. | 292/165 X |
| 4,986,583 | 1/1991 | Campbell et al. | 292/336.3 |
| 5,190,327 | 3/1993 | Lin | 292/357 X |
| 5,385,374 | 1/1995 | Fann et al. | 292/DIG. 53 X |

FOREIGN PATENT DOCUMENTS

| | | | |
|---|---|---|---|
| 962717 | 2/1975 | Canada | 292/165 |
| 8374 | of 1909 | United Kingdom | 292/357 |
| 461789 | 2/1937 | United Kingdom | 292/357 |

*Primary Examiner*—Rodney M. Lindsey
*Attorney, Agent, or Firm*—Robert F. Palermo

[57] ABSTRACT

A thumb actuated latch retracting mechanism, for mounting with a grip handle on a door, includes a thumbpiece, the thumbpiece having a laterally offset cam on a second end thereof; an escutcheon plate having an opening through which the second end of the thumbpiece and the cam protrude into a door preparation cavity; and provision within the cavity for retracting a latchbolt in response to pressing the thumbpiece, the provision including a chassis mounted to the escutcheon and containing further provisions for converting linear motion of the thumbpiece cam to rotary motion of a spindle for retracting the latchbolt. The chassis also has tabs which act as barbs to hold the handle and mechanism against the door when pushed into mounting position and to simplify installation.

8 Claims, 1 Drawing Sheet

THUMB ACTUATED LATCH RETRACTING MECHANISM FOR GRIP HANDLE LOCKS INCLUDING INTEGRAL INSTALLATION GRIPPING AID

This application is a continuation of U.S. patent application Ser. No. 08/296,886 filed Aug. 29, 1994, now abandoned.

BACKGROUND OF THE INVENTION

This invention relates generally to door locks and more particularly to a mechanism providing rotary motion about one axis in response to rotary motion about another orthogonal axis while simplifying installation of the door lock.

Grip handle door locks generally are equipped with thumb latches which convert a linear motion of an operator's thumb into a rotary motion to withdraw a latchbolt and open a door. Most thumb actuated latches require field assembly of several components in the door preparation cavity. This assembly is difficult; because it involves holding the grip handle and other outside parts in place while bolts or screws are installed from the inside by the installer. It is awkward at best to hold parts in position with one hand on one side of a door while installing other parts and screws with the other hand from the other side. The result is excessive installation time and, sometimes, faulty performance of the lock mechanism.

A lot of the difficulty described is attributable to alignment of parts for a lever-rack-pinion-spindle combination. Even though no individual alignment is difficult, maintaining all the alignments simultaneously on one side of the door while installing fasteners from the other side is very difficult. Of course, not all thumb actuated latches are equally complex and difficult to install. Many are of simpler construction, but the two-sided alignment problem persists.

The foregoing illustrates limitations known to exist in present thumb actuated grip handle locks, and it would, therefore, be advantageous to provide an alternative directed to overcoming one or more of those limitations. Accordingly, a suitable alternative is provided including features more fully disclosed hereinafter.

SUMMARY OF THE INVENTION

In one aspect of the present invention, a thumb actuated latch retracting mechanism, for mounting with a grip handle on a door, is provided, including a thumbpiece with a laterally offset cam on a second end thereof; an escutcheon plate having an opening through which the second end of the thumbpiece and the cam protrude into a door preparation cavity; and means, mounted to the escutcheon, for retracting a latchbolt in response to pressing the thumbpiece.

The foregoing and other aspects of the invention will become apparent from the following detailed description, when considered in conjunction with the accompanying drawing.

DETAILED DESCRIPTION

Figure 1:
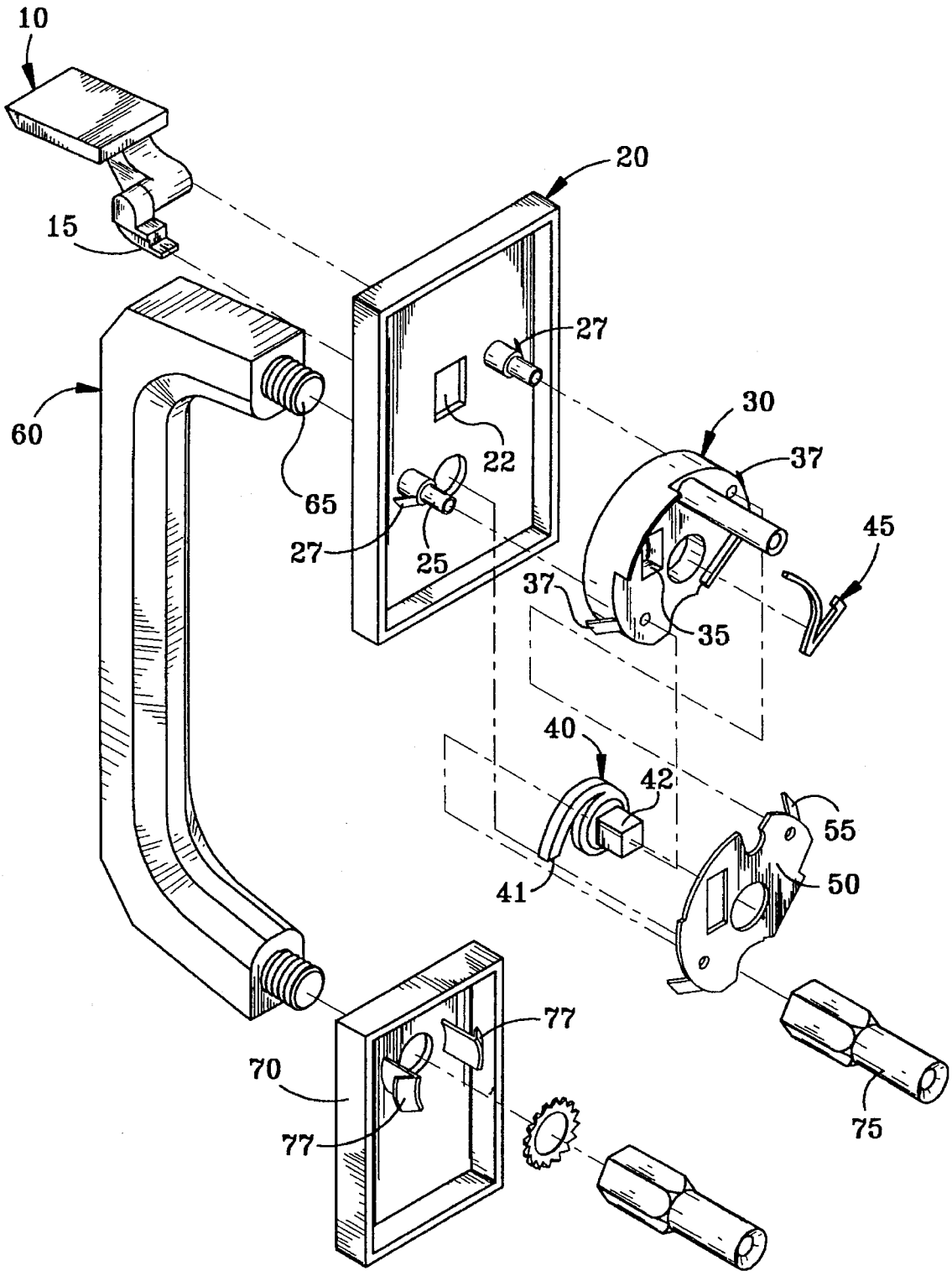
FIG. 1 is an exploded perspective view illustrating an embodiment of the thumb actuated latch retracting mechanism of the present invention.

FIG. 1 shows the thumb actuated latch retraction device in exploded perspective. Grip handle 60 has studs 65 for attaching through escutcheons 20 and 70 to inside door hardware (not shown) by means of stud nuts 75. Grip handle 60 is a dead handle and is only related in an ancillary way to the invention.

Thumbpiece 10 has a laterally offset cam 15 rigidly projecting. Cam 15 is inserted through opening 22 of escutcheon 20, and chassis 30 is mounted to the escutcheon on studs 25. This causes cam 15 to protrude slightly from opening 35 and to be in contact with lever 41 of lever equipped spindle 40. Spring 45 biases spindle 42 and, through cam 15, thumbpiece 10 to a neutral (or latch bolted) position. Chassis cover plate 50 is preferably installed on chassis 30 to exclude dirt, and studs 25 either have nuts or other fasteners (not shown) installed or are riveted by upsetting or rolling the ends of studs 25.

A module can be made-up from the thumbpiece 10, escutcheon 20, chassis 30, lever equipped spindle 40, spring 45, and cover plate 50. Of course, preferably, grip handle 60 and lower escutcheon 70 can be added along with stud nuts 75 to make a complete grip handle module. To assist in installation of the module, tabs 55 are provided on cover plate 50 to act as barbs and to grip the door preparation cavity when the assembly is pushed into place. If the cover plate 50 is not used, the tabs 27 can be attached directly to, or formed as part of, the escutcheon 20 so that they are outside the chassis 30 when it is installed on the escutcheon 20. This allows installation of inside door hardware without having to hold manually the outside module in place. Tabs 37 could as well be included on the chassis 30 in case cover plate 50 were not needed or wanted. These three tab arrangements are shown as alternatives. Clearly only one of the three alternatives would be needed or desired in a given assembly.

In operation, when thumbpiece 10 is pressed cam 15 rotates upward because chassis 30, behind opening 35 supports the end of the thumbpiece and provides a pivot axis. When cam 15 swings up, it pushes lever 41 and rotates spindle 42. Spindle 42 operates the latchbolt (not shown) to open the door. When the thumbpiece is released, the spring bias forces the cam down and the bolt extends to again latch the door.

The integral grip tabs provide a very real advantage during installation especially with the ability to modularize the assembly. It is also desirable, when using a dummy grip handle without an operable thumbpiece, to provide grip tabs or barbs on the back of the escutcheon 70 plates to afford the same installation assistance as provided in the operable embodiment. This dummy handle embodiment is shown in the FIGURE only on the lower escutcheon 70, since, in the case of a dummy handle, both the upper and lower escutcheons would be as shown for escutcheon 70. The tabs 77 in this case are provided as part of two plain escutcheons 70 rather than as part of a latch retraction mechanism 30 which is attached to an escutcheon 20.

What is claimed is:

1. A modular thumb actuated latch retracting mechanism, for mounting with a grip handle on a door, comprising:

a thumbpiece having a laterally offset cam on a second end thereof;

an escutcheon plate having an opening through which the second end of said thumbpiece and said cam protrude into a door preparation cavity and a second opening through which said grip handle protrudes for engagement with fastening means for attachment to said door; and a chassis mounted to said escutcheon, said chassis comprising a laterally offset opening for the cam of said thumbpiece and another, centered, opening providing a bearing surface for a lever-equipped spindle assembly; the lever of said spindle assembly resting against said cam of the thumbpiece; a spring for biasing said spindle to a bolt latched position; and a cover plate providing another bearing surface for said spindle assembly.

2. The modular mechanism of claim 1, wherein the thumbpiece, escutcheon, chassis, spindle, spring, and cover plate are riveted together after assembly.

3. The modular mechanism of claim 1, further comprising:

means, mounted to said escutcheon, for gripping said door preparation cavity and for thereby aiding installation.

4. The modular mechanism of claim 3, wherein the means, mounted to said escutcheon, for gripping said door preparation cavity and for thereby aiding installation comprises a plurality of tabs projecting outwardly from the edge of said chassis.

5. The modular mechanism of claim 3, wherein the means, mounted to the escutcheon, for gripping said door preparation cavity and for thereby aiding installation comprises a plurality of tabs fixed to said escutcheon such that said tabs are adjacent the chassis when said chassis is installed on said escutcheon.

6. The modular mechanism of claim 1, further comprising:

a plurality of tabs extending outwardly from an outer edge of said cover plate, said tabs gripping said door preparation cavity and thereby aiding installation.

7. A gripping aid for installation of a grip handle together with escutcheons on a door, comprising:

means, mounted on said escutcheons, for gripping said door in a door preparation cavity and for thereby holding said escutcheon against said door to aid in installation of said grip handle.

8. The gripping aid of claim 7, wherein the means for gripping said door preparation cavity comprises a plurality of tabs projecting from said escutcheons, said tabs being of sufficient length and having a configuration to slide into a door preparation cavity when said escutcheon is pressed against the door and to engage walls of said cavity to grip said door and to resist removal of said escutcheon therefrom.

* * * * *